United States Patent [19]

Yates

[11] Patent Number: 4,492,150

[45] Date of Patent: Jan. 8, 1985

[54] ACTUATOR FOR MECHANICAL APPARATUS

[76] Inventor: Harlan W. Yates, 10035 Third Ave. South, Minneapolis, Minn. 55420

[21] Appl. No.: 509,994

[22] Filed: Jul. 1, 1983

[51] Int. Cl.[3] ..... F15B 15/24

[52] U.S. Cl. ..... 92/13.6; 92/121; 417/481

[58] Field of Search ..... 92/13.6, 121, 122, 125, 92/123, 13.5; 91/167 A, 376 A; 417/481

[56] References Cited

U.S. PATENT DOCUMENTS

| | | | |
|---|---|---|---|
| 2,911,956 | 11/1959 | Smith, Jr. | 91/167 A |
| 3,171,332 | 3/1965 | Randle | 92/13.5 |
| 3,426,652 | 2/1969 | Blake | 92/121 |
| 4,027,576 | 6/1977 | Nomura | 92/122 |
| 4,121,738 | 10/1978 | Virag | 92/13.6 |
| 4,192,224 | 3/1980 | Okamura | 92/125 |

FOREIGN PATENT DOCUMENTS

| | | | |
|---|---|---|---|
| 3044324 | 7/1981 | Fed. Rep. of Germany | 92/121 |

*Primary Examiner*—Robert E. Garrett
*Assistant Examiner*—Richard S. Meyer
*Attorney, Agent, or Firm*—Herman H. Bains; Malcolm L. Moore; Conrad A. Hansen

[57] ABSTRACT

A rotary fluid pressure actuator device includes a housing comprised of a pair of housing members interconnected together for relative movement therebetween. A vane rotor assembly is positioned in the housing and is rotationally reciprocated in response to the direction of flow of fluid to and from the interior of the housing members. The housing members are provided with internal stops which are adjustable with respect to each other to permit the rotational stroke of the vane rotor assembly to be variously adjusted. Rotary movement of the vane rotor assembly is transmitted directly or through a shaft to another device for actuation thereof.

10 Claims, 18 Drawing Figures

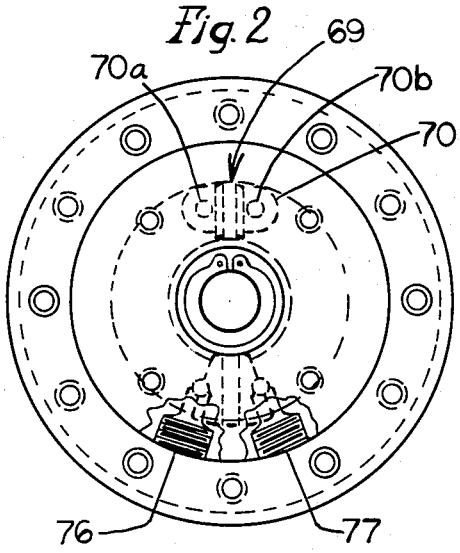
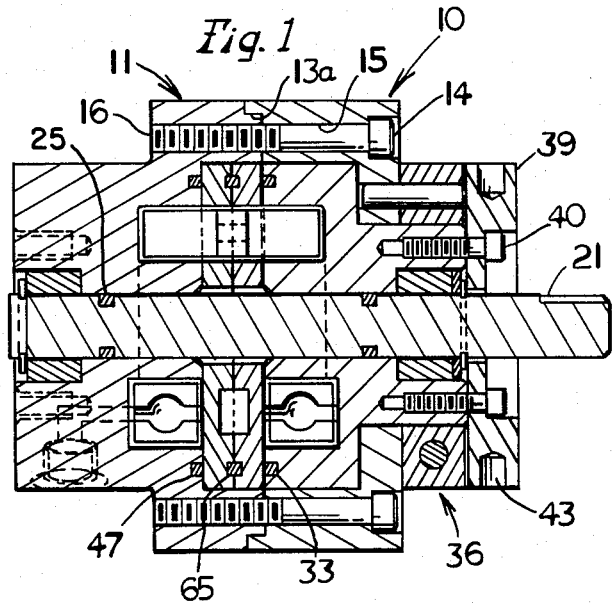
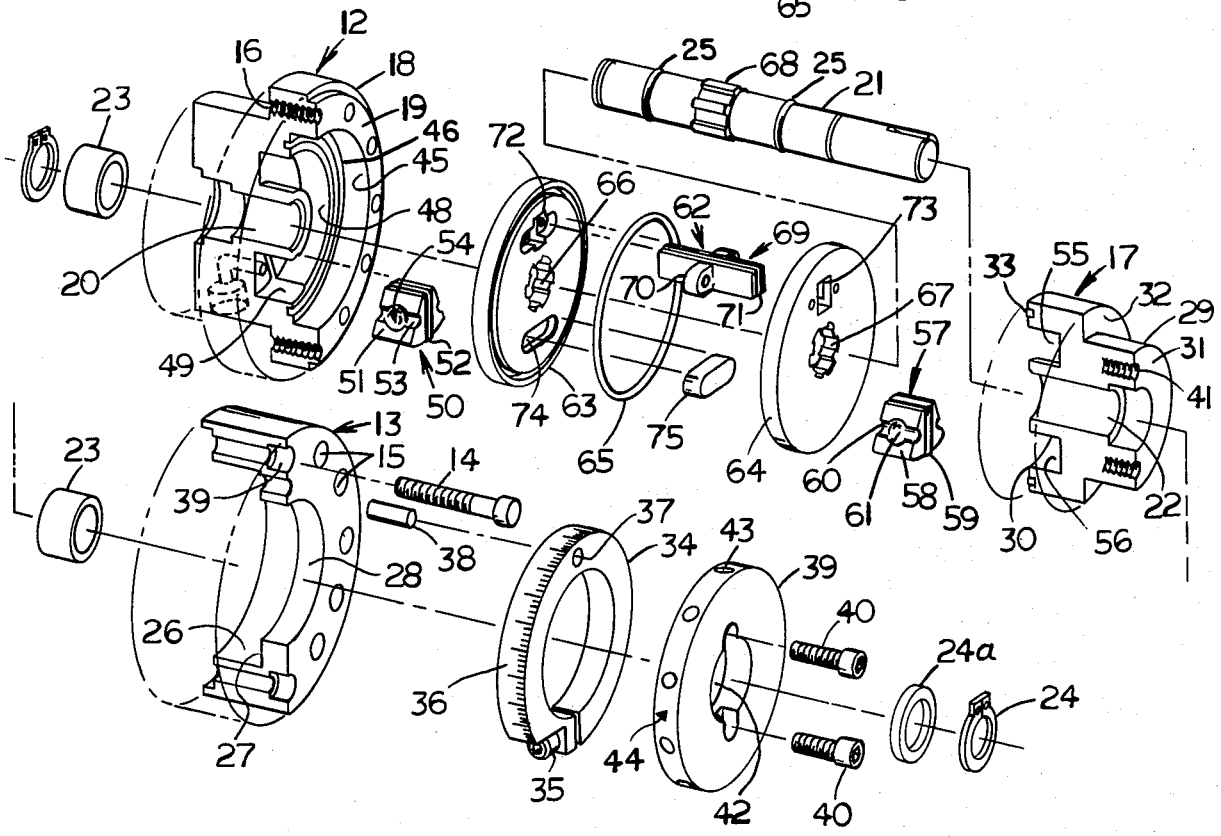
Fig. 3

Fig. 5
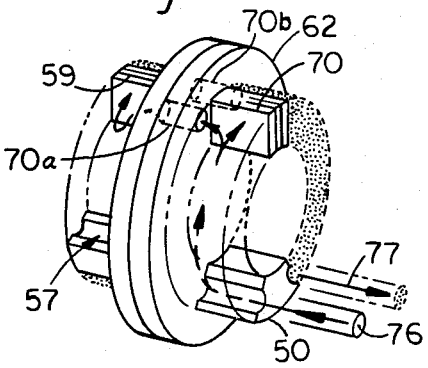
Fig. 6
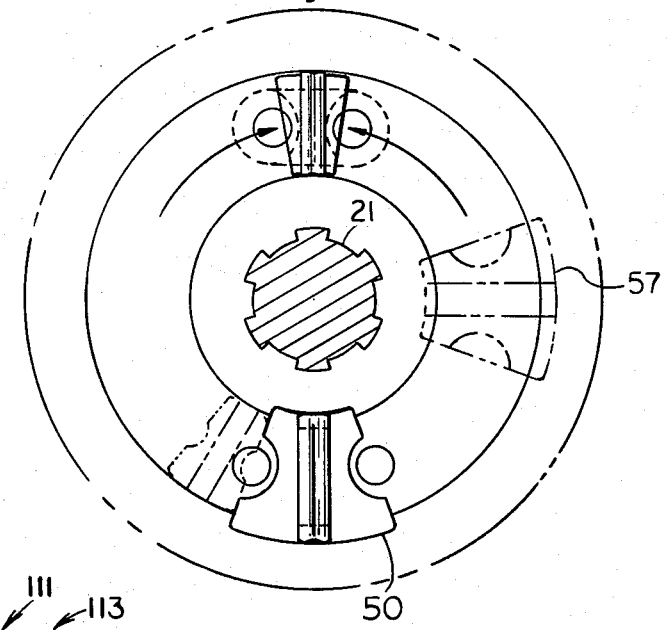
Fig. 7
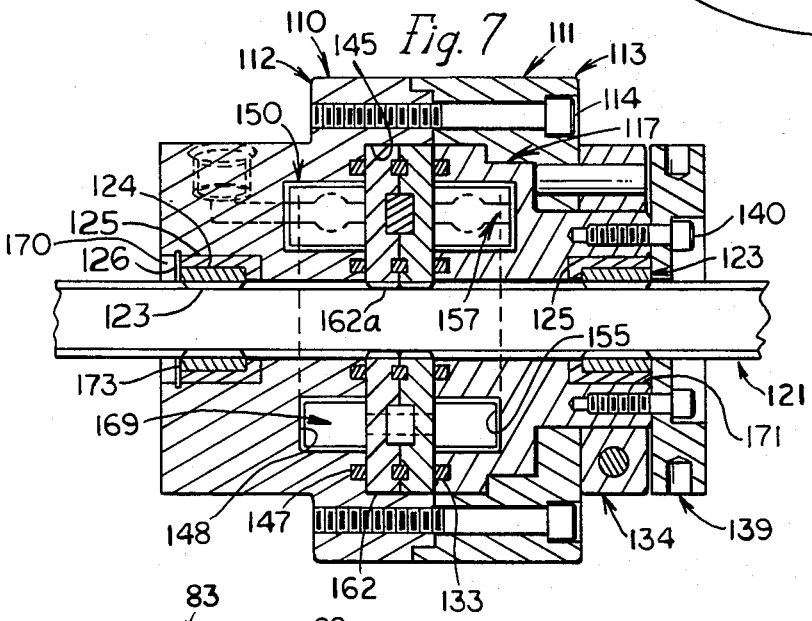
Fig. 8
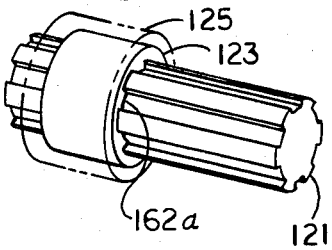
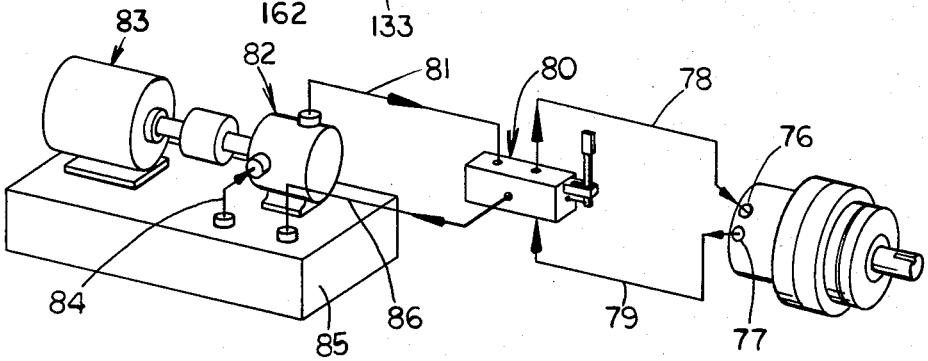
Fig. 4

Fig. 9
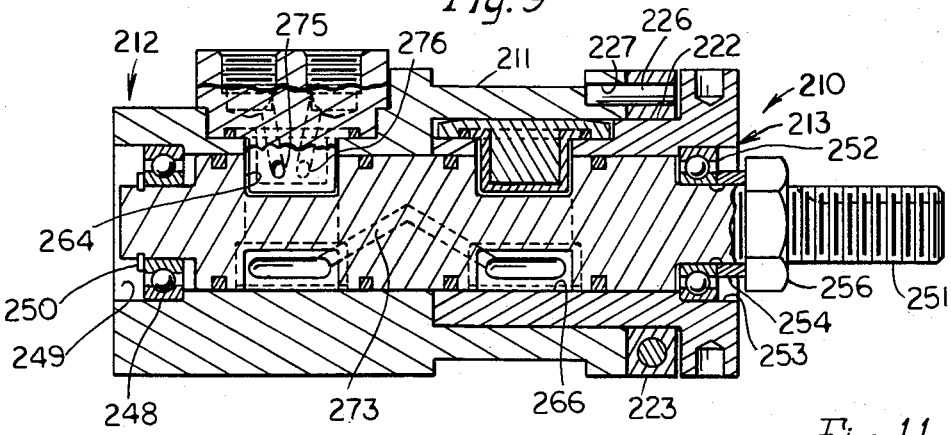
Fig. 11
Fig. 10
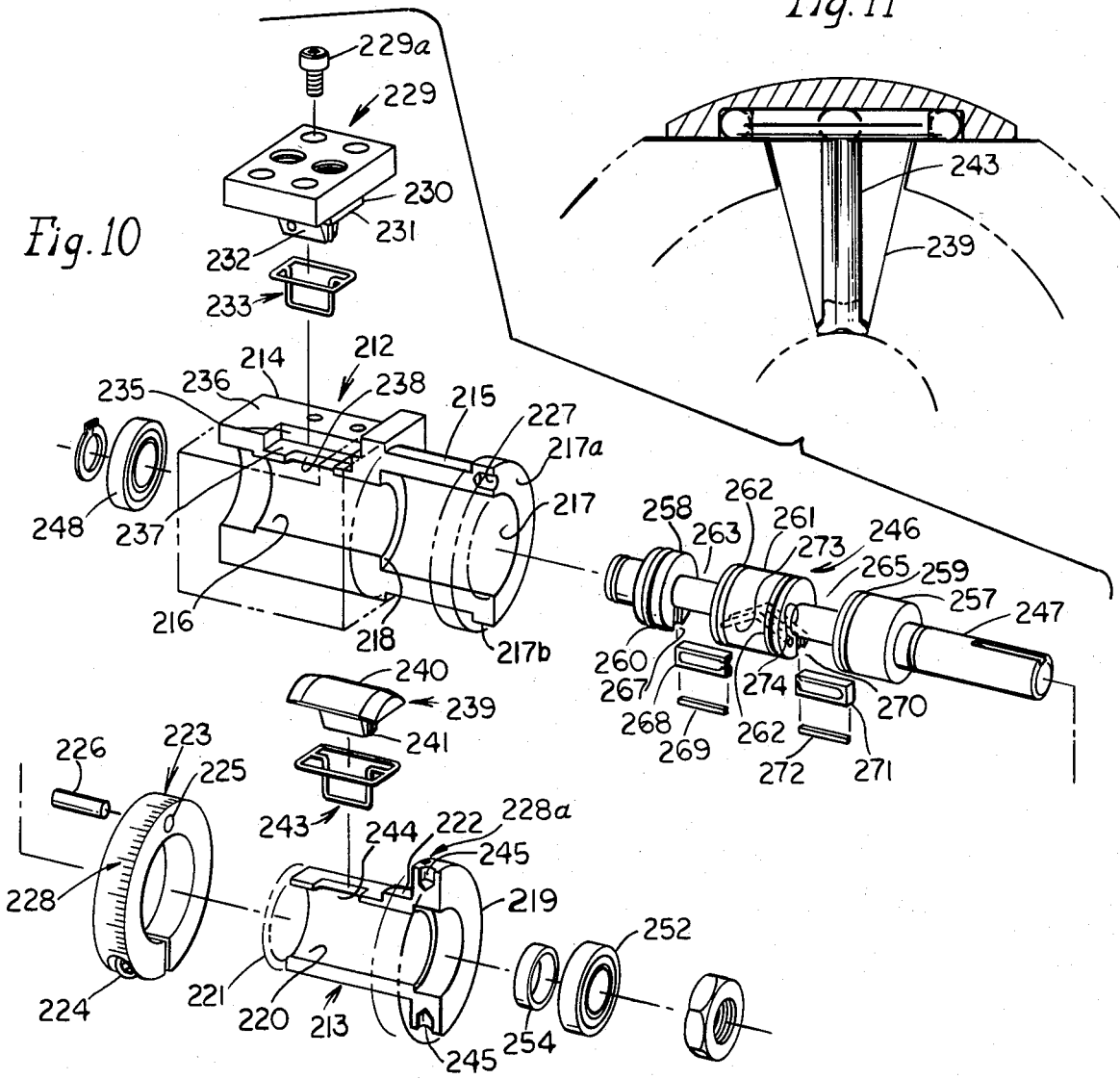

Fig. 13
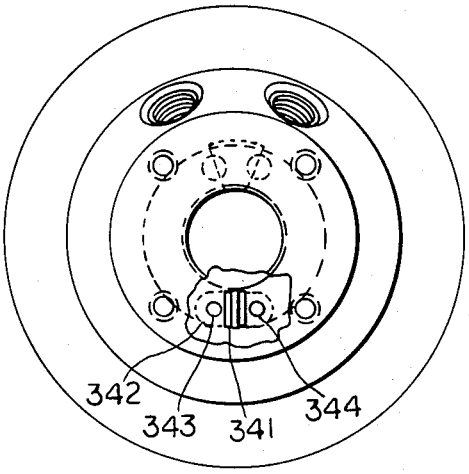
Fig. 12
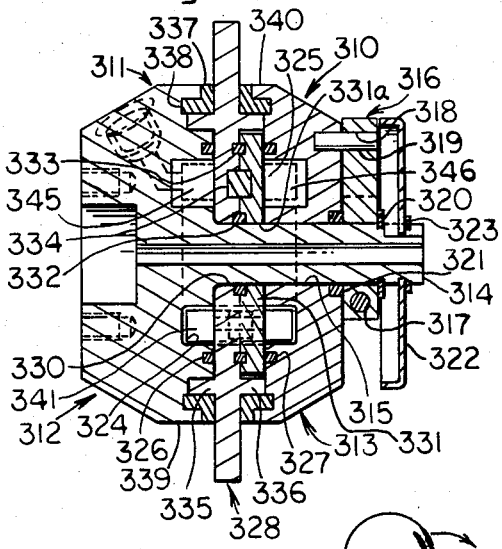
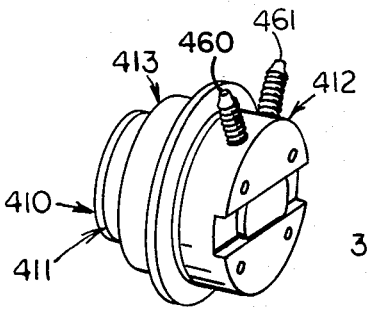
Fig 16
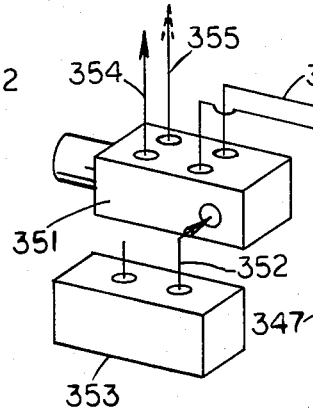
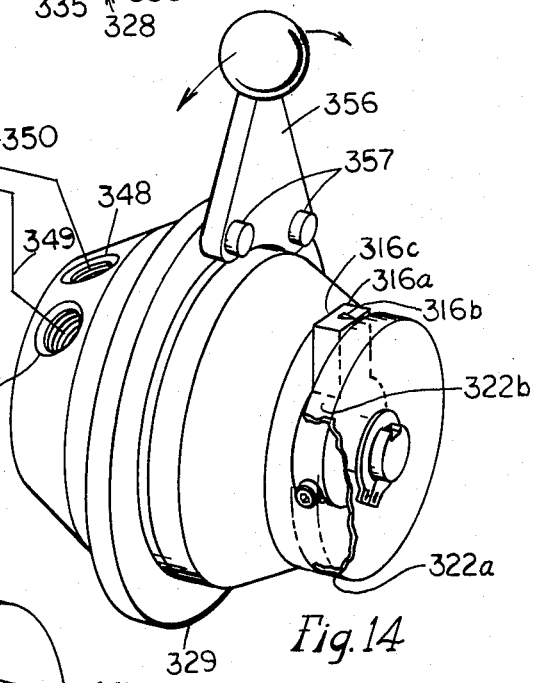
Fig. 14
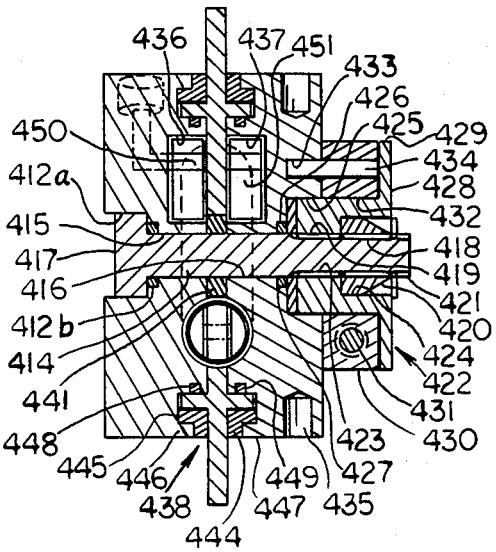
Fig. 15
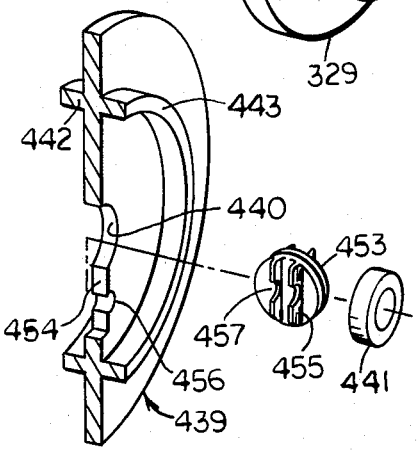
Fig. 17
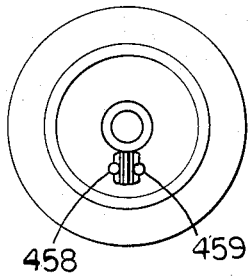
Fig. 18

ACTUATOR FOR MECHANICAL APPARATUS

SUMMARY OF THE INVENTION

This invention relates to a device for producing rotary motion used in mechanically operating another apparatus.

There are many different kinds of actuator devices that are used to actuate or operate other devices, such as valve switches, robots and the like. Some of these systems are effective as actuators, but are quite expensive. Because of the complexity and expense of some of these systems, they are not used to control and operate certain simple mechanical functions.

It is therefore a general object of this invention to provide a novel adjustable fluid pressure device, of simple and inexpensive construction, for producing reciprocating rotary motion that is used in operating another device, such as robots, valves, switches and the like.

A more specific object of this invention is to provide a fluid pressure device having internal adjustable stops for variously adjusting the stroke of the oscillating shaft, thereby increasing the range of utility of the fluid pressure device in mechanically controlling and operating another device.

These and other objects and advantages of my invention will appear more fully from the following description made in conjunction with the accompanying drawings wherein like reference characters refer to the same or similar parts throughout the several views.

FIGURES OF THE DRAWING

FIG. 1 is a cross-sectional view of one embodiment of the fluid pressure actuator device;

FIG. 2 is an end elevational view of one embodiment of the device;

FIG. 3 is an exploded perspective view of the device;

FIG. 4 is a diagrammatic perspective view of the device illustrated as a component of a hydraulic circuit;

FIG. 5 is a diagrammatic perspective view of the vane rotor assembly illustrating the flow pattern of the fluid;

FIG. 6 is a diagrammatic end view of the device illustrating certain parts thereof in adjusted positions by dotted line configurations;

FIG. 7 is a cross-sectional view of a modified form of the fluid pressure actuator device;

FIG. 8 is a diagrammatic perspective view of the shaft and vane rotor assembly of the embodiment of FIG. 7;

FIG. 9 is a cross-sectional view of another embodiment of the fluid pressure actuator device;

FIG. 10 is an exploded perspective view of the device illustrated in FIG. 9;

FIG. 11 is a cross-sectional view through the port block and fixed stop illustrating the fluid pressure passages therein;

FIG. 12 is a cross-sectional view of a different embodiment of the fluid pressure actuator device;

FIG. 13 is an end elevational view of the device illustrated in FIG. 12;

FIG. 14 is a perspective view of the device illustrated in FIG. 12 with certain parts broken away for clarity and diagrammatically illustrating components of the hydraulic circuit;

FIG. 15 is a cross-sectional view of a different embodiment of the fluid pressure actuator device;

FIG. 16 is a perspective view of the device illustrated in FIG. 15;

FIG. 17 is a fragmentary perspective view of the rotary disk of the rotor vane assembly of the device illustrated in FIG. 15; and FIG. 18 is an elevational view of the disk illustrated in FIG. 17.

DESCRIPTION OF THE PREFERRED EMBODIMENT

Referring now to the drawings, and more specifically to FIGS. 1 to 6, it will be seen that one embodiment of the novel rotary fluid pressure device, designated generally by the reference number 10, is thereshown. The device 10 includes a housing 11 which is comprised of a barrel or outer housing member 12 and a barrel or outer housing member 13 which are secured together by suitable bolts 14 that pass through openings 15 in the barrel 13 and threadedly engage in threaded openings 16 in the outer housing member 12. The outer housing member 13 also has an inner housing member 17 positioned therein, as shown in FIG. 2.

The outer housing member 12 is of generally cylindrical configuration and has an annular flange 18 projecting radially outwardly from adjacent one end thereof. The flange 18 presents a face that engages a corresponding face on the outer housing member 13. It will also be noted that the threaded recesses 16 are in flange 18 and are threadedly engaged by the bolts 14.

The outer housing member 12 also has an axially extending lip 19 which projects from one end thereof and fits within an annular recess **13*a* of the outer housing member 13. It will be seen that when the housing members 12 and 13** are secured together, the confronting faces of the housings engage each other.

The outer housing member 12 has a centrally located axial bore 20 therethrough, and a shaft 21 projects through the bore 20 and through an axial bore 22 in the inner housing member 17. Suitable bearings 23 journal the shaft 21 in the outer housing 12 and the inner housing 17. Retaining rings 24 secure the shaft 21 against axial movement relative to the outer housing 12 and the inner housing member 17. A spacer **24*a* is interposed between the retaining ring 24 and bearing 23 in the inner housing member 17. The shaft 21 also has a pair of axially spaced apart O-ring seal elements 25 secured thereto and engaging the inner surfaces of the bores in the outer housing 12 and the inner housing 17. With this arrangement, it will be seen that the shaft 21 is mounted for rotation relative to the housing 11**.

The outer housing member 13 has an annular recess 26 therein which defines an annular face 27 having an opening 28 therethrough. The opening 28 is coaxial with the opening 22 in the inner housing member 17. In this regard, it will be noted that the inner housing member 17 is of cylindrical configuration, including a reduced cylindrical portion 29 which projects axially therefrom. The inner housing member 17 has a front annular face 30, a rear annular face 31 and an intermediate, rearwardly facing annular face 32. The front annular face is provided with a groove for accommodating an O-ring seal 33 therein. It will be seen that when the inner housing member 17 is positioned within the outer housing member 13, it is received within the annular recess 26 so that the intermediate face 32 thereof engages the annular face 27 of the outer housing member 13. The reduced cylindrical portion 29 of the inner housing member 17 projects through the opening 28, as best seen in FIG. 1.

A clamp ring 34 is mounted on the reduced cylindrical portion 29 of the inner housing member 17, and is secured thereon by a bolt 35 in a well-known manner. The clamp ring 34 is provided with calibrations along the circumferential outer surface thereof to define an indicator dial 36. The clamp ring 34 also has an axial opening 37 therethrough which accommodates a retainer pin 38 that projects into an opening 39 in the outer housing member 13 to retain the clamp ring against rotation relative to the inner housing member 17.

A substantially flat, circular adjusting ring 39 is secured to the inner housing member 17 against the rear face 31 thereof by suitable bolts 40 which threadedly engage in recesses 41 in the inner housing member 17. The adjusting ring 39 has a centrally located opening 42 therethrough which accommodates the end portion of the shaft 21. It will also be noted that the adjustment ring 39 has a plurality of spaced apart, radially extending openings 43 therein arranged throughout the circumference thereof to facilitate gripping of the adjustment ring by a spanner wrench or similar tool so that the adjusting ring and inner housing member 17 may be rotated as a unit relative to the clamp ring 34 and the outer housing member 13. It will further be noted that the adjusting ring 39 has an indicator arrow 44 on the circumferential surface thereof that cooperates with the calibrated dial 36 on the clamp ring to indicate a predetermined reading of a movable stop member in a manner to be described more fully herein below.

It will be noted that the outer housing member 12 has an annular recess 45 therein which extends axially from the lip 19 and terminates in an annular radial face 46. The face 46 has a groove therein for accommodating an O-ring seal 47. The outer housing member 12 also has a smaller annular recess 48 therein which is positioned concentrically between the annular recess 46 and the opening 20 through the outer housing member 12. It will be noted that the annular recess 48 is displaced axially from the annular recess 46. The outer housing member 12 also has a positioning recess 49 therein which communicates with the annular recess 48. The positioning recess 49 is adapted to receive a fixed stop member 50 therein. It will be seen that the stop member 50 is of generally wedge-shaped configuration, having opposed converging faces 51. The fixed stop member also has a pair of annular seal elements 52 extending therearound. Each face 51 has a groove-shaped passage 53 therein, and the central portion of the passage is enlarged, as at 54.

The inner housing member 17 also has an annular recess 55 therein which is positioned concentrically around the opening 22 therethrough. When the housing 11 is assembled, the annular recess 55 faces and is disposed in registering relation with the annular recess 45 in the outer housing member 12. The inner housing member 17 also has a positioning recess 56 therein which accommodates a movable stop member 57. The movable stop member 57 is identical in construction to the fixed stop member 50 and is of generally wedge-shaped configuration and includes opposed converging faces 58. Seal elements 59 extend around the central portion of the movable stop element 57 in the identical manner as the fixed stop member 50. Each of the faces 58 has a groove-shaped passage 60 therein, and the central portion of each passage is enlarged, as at 61.

The device 10 also includes a vane rotor assembly 62 which includes a vane disk 63 and a vane disk 64 which are secured together in face-to-face relationship. The disks 63 and 64 are of substantially identical construction, and an O-ring seal 65 is positioned in a groove in vane disk 63 and forms a seal between the disks. The disk 63 has a central opening 66 therein and the disk 64 has a central opening 67 therein which accommodate the shaft 21. It will be noted that the central portion of the shaft 21 is provided with a plurality of splines 68 that engage in peripheral recesses of the openings in the vane disks 63 and 64 so that the rotor assembly is fixed to the shaft for rotation therewith.

The vane rotor assembly 62 also includes a generally rectangular shaped vane 69 having a pair of ears 70 projecting laterally from the mid portion thereof. The vane is also provided with O-ring seals 71 that extend around the central periphery thereof. The vane disk 63 is provided with an opening 72 and the vane disk 64 is provided with an opening 73 for accommodating the vane and vane ears therein. When the vane rotor assembly 62 is assembled, the vane will project axially beyond the disks 63 and 64. To facilitate assembly, the disk 63 is provided with an opening 74 therein for accommodating an alignment lug 75.

The vane rotor assembly 62 will be positioned in the housing 11 so that the disks 63 and 64 are positioned in the annular recess 45 of the outer housing member 12. It will be noted that the assembled disk rubs or wipes against and engages the O-ring seal 33 in the inner housing member 17 and the O-ring seal 47 in the outer housing member 12. One end portion of the vane 69 projects into the annular recess 48 of the outer housing member 12, and the other end portion of the vane projects into the annular recess 55 in the inner housing member 17. The annular seals 71 engage and make sealing contact with the surfaces defining these respective annular recesses.

It will be seen that when the vane rotor assembly 62 is positioned within the housing, the interior thereof is divided into a pair of chambers. One of the chambers is defined by the annular recess 48 in the outer housing member 12 and the other chamber is defined by the annular recess 55 in the inner housing member 17. The respective end portions of the vane 69 project into these chambers. The vane is caused to move by the action of fluid pressure against the surfaces thereof.

In the preferred embodiment, hydraulic liquid is used to operate the device, but it is pointed out that air or other gases may also be used. Hydraulic fluid is introduced into the annular recess 45 through ports 76 and 77 in the outer housing member 12. Ports 76 and 77 are connected by suitable hydraulic fittings which in turn are connected by conduits 78 and 79 to the control valve 80. Control valve 80 is connected by conduit 81 to a pump 82. Pump 82 is operated by a motor 83. A conduit 84 connects a reservoir 85 to the pump 82 and a conduit 86 interconnects the reservoir with the control valve 80.

It will be noted that the ports 76 and 77 communicate with the chamber defined by the annular recess 45 on opposite sides of the fixed stop member 50. In this regard, it will be noted that the passages in the faces of the stop member 50 facilitate the flow of fluid into the chamber defined by the annular recess 48. It will be noted that one ear 70 on the vane 69 has a transfer port 70*a* therethrough, and the other ear has a transfer port 70*b* therethrough. This permits the fluid to pass through the transfer ports from the chamber defined by the annular recess 48 and the chamber defined by the annular recess 55.

In operation, fluid under pressure will be supplied through the port 76 into the chamber defined by the annular recess 48. Assuming that the vane 69 is positioned against the stop member 50 adjacent the port 76, fluid will begin to fill the volumetric space between the vane and the stop member, and will also flow through one of the transfer ports 70*a* and 70*b* into the chamber defined by the annular recess 55. The fluid will fill the chamber defined by the annular recess 55 between the vane and the distal face of the movable stop member 57. Thereafter, as fluid continues to flow into the chamber defined by the annular recess 45, the pressure exerted against the vane will move the vane toward the movable stop member 57. Fluid located in the chamber defined by the annular recess 55 will be urged through the transfer port 70*b* into that portion of the chamber defined by the annular recess 45 that communicates with the port 77. The vane will continue in its direction of movement until it contacts the movable stop member 57. It is pointed out that the movable stop member 57 will remain in a fixed position until it is adjusted. The control valve 80 will reverse the flow of fluid so that fluid will flow under pressure through the port 77 and engage the other side of the vane 69. The fluid will also flow through the transfer port 70*b* to fill that portion of the chamber defined by the annular recess 55 between the vane 69 and the movable stop member 57. The vane 69 will then be moved in an opposite direction until the vane engages the fixed stop member 50. This reciprocating movement of the vane is immediate and smooth. Movement of the vane produces rotation of the shaft 21. The shaft 21 will operate a component of a machine that requires a reciprocating rotary motion.

If it is desirable to lengthen or shorten the reciprocating stroke of the shaft, an operator will loosen the clamp ring 34 which allows rotational movement of the adjusting ring 39. Rotation of the adjusting ring also moves the inner housing member 17 therewith so that the movable stop member will be repositioned relative to the fixed stop member. The pointer 44 on the adjusting ring 39 cooperates with the indicator dial of the clamping ring to permit precise positioning of the movable stop member.

It is also pointed out that since the ports 76 and 77 do not communicate with each other, and since those portions of the chambers located on opposite surfaces of the vane do not communicate with each other, a liquid and a gas may be used to operate the device. For example, an hydraulic liquid may be introduced through the port 76 as the incoming liquid and a gas may be introduced and evacuated through the port 77. This permits a variation in the operation of the device.

Referring now to FIGS. 7 and 8, it will be seen that the embodiment disclosed therein is generally referred to by the reference numeral 110 and is similar in construction and operation to the embodiment of FIGS. 1 to 6. This embodiment differs only slightly from the embodiment of FIGS. 1 to 6 and a complete detailed description is thought to be unnecessary. The rotary fluid pressure device 110 includes a housing 111 comprised of an outer housing member 112 which is secured to outer housing member 113 by bolts 114. An inner housing member 117 is positioned within the outer housing member 113 in confronting relation with the outer housing member 112. A shaft 121 projects through openings in the outer housing member 112 and the inner housing member 117. The shaft also projects through the adjustment ring 139 and the clamping ring 134. The adjustment ring is secured to the inner housing member by bolts 140.

The outer housing member 112 has an annular recess 145 and an annular recess 148 therein. Similarly, the inner housing member 117 has an annular recess 155 therein which cooperates with the annular recess 148 to define opposed annular chambers in the manner of the embodiments of FIGS. 1 to 6. The outer housing member 112 also has a fixed stop member 150 positioned in a positioning recess therein, and the inner housing member 117 also has a movable stop member 157 positioned in a positioning recess therein.

The vane rotor assembly 162 is provided with inwardly projecting splines 162*a* that engage splines 168 on the shaft 121. The vane rotor assembly is otherwise identical to the embodiment of FIGS. 1 to 6. Thus, the vane rotor assembly includes vane disk 163 and vane disk 164. A vane 169 is carried by the disks and projects into the chambers defined by the annular recesses 148 and 155, respectively. Fluid is supplied to the chambers defined by these recesses in the same manner as that of the embodiment of FIG. 1. When the vane rotor assembly 162 is revolved, the disks rub against the seals 147 and 133 in the outer housing member 112 and the inner housing member 117, respectively. The only essential difference in the embodiment of FIGS. 7 and 8, with respect to the embodiment of FIGS. 1 to 6, is the provision of the shaft 121 with splines throughout its length. In this regard, spline bearings 123 are provided, one of which is positioned in an annular recess 170 in the outer housing member 112, and the other bearing 123 being positioned within an annular recess 171 in the inner housing member 117. Each bearing member 123 includes an inner sleeve 124 which has internal splines that interdigitate and engage in the grooves defined between adjacent splines 168 on the shaft 121. Each bearing 123 also includes an outer bearing ring 125 which is journaled on the inner bearing sleeve 124 and permits rotation of the shaft 121 and inner bearing sleeve 124 relative thereto.

It will be seen that the bearing positioned within the outer housing member 112 has a retaining ring 173 engaging in a recess in the housing member 112 to retain the bearing against axial displacement. The other bearing is retained in place by the adjustment ring 139.

Since the shaft 121 is splined throughout its length or a major portion of its length, this permits the device to be moved relative to the shaft 121 as desired. This kind of adjustment is desirable under certain conditions. The device may be retained in an adjusted position by bearings (not shown) which engage the outer housing member 112 and the adjustment ring 139.

Referring now to FIGS. 9, 10 and 11, it will be seen that another embodiment of the rotary fluid pressure device, designated generally by the reference numeral 210, is thereshown. The device 210 also includes a housing 211 comprised of a housing member 212 and a housing member 213 telescopically received within the housing member 212. The housing member 212 includes a block portion 214 which accommodates a port block and fixed stop member therein and a barrel portion 215 which telescopically receives the housing 213 therein.

The block portion 214 of the housing member 212 has an axial opening 216 therethrough which communicates with an axial opening 217 in the barrel portion 215. It will be noted that the axial opening 217 is larger in diameter than the axial opening 216 to thereby define an annular face 218 therebetween.

The housing member 213 is of generally cylindrical configuration, and is provided with a radial flange 219 at one end thereof extending radially outwardly therefrom. The housing member 213 is provided with an axial opening 220 therethrough which corresponds in size to the opening 216 in the block portion of housing member 212. It will be seen that when the housing member 213 is telescopically positioned within the barrel portion 215 of the housing member 212, the end 221 of the housing member 213 will engage the face 218 of the housing member 212. The opening 220 will be coaxially disposed with respect to the axial opening 216 in the housing member 212.

The rotary fluid pressure device 210 is provided with a clamp ring 223 which is positioned upon a reduced flange portion 222 of the housing member 213. The clamp ring 223 is split ring type, and is provided with a bolt 224 that engages in a threaded recess to allow loosening and tightening of the clamp ring. The clamp ring 223 also has an axial opening 225 therein that accommodates a retainer pin 226 therein. The retainer pin 226 is also received within an axial opening 227 which extends axially from the face **217*a* of the barrel portion 215 of the housing member 212**.

It will be seen that when the rotary fluid pressure device 210 is assembled, the clamp ring 223 will be retained against revolving movement relative to the housing member 212. It will further be noted that the clamp ring 223 is provided with a scale on the exterior surface thereof which defines an indicator dial 228. The outer circumferential surface of the flange **217*b* of the housing member 212 is provided with a pointer 228*a* to indicate the amount of adjustment of the housing member 213 relative to the clamp ring 223**.

The housing member 212 is provided with a generally rectangular shaped port block 229 which is mounted on the upper surface thereof by suitable bolts **229*a* which thread into threaded openings in the housing 212. The port block 229 has a fixed stop member 230 rigidly affixed to the lower surface thereof and forming a part thereof. The fixed stop member 230 includes an upper transverse rectangular portion 231 and a tapered stem 232 that depends therefrom. The tapered stem is provided with seal element 233 which is positioned in a rectangular slot in the lower surface of the transverse rectangular portion 231** and also extends around the stem of the fixed stop member.

The block portion 214 of the housing 212 has a generally rectangular shaped recess 235 formed in the upper surface thereof, and the recess 235 presents an upwardly facing, generally rectangular shaped, flat lower surface 237. It will be seen that when the port block 229 is mounted on the upper surface 236 of the block portion 214, the transverse rectangular portion 231 of the fixed stop member will be positioned upon the lower surface 237 of the rectangular recess 235. The seal elements 233 will engage this lower surface 237 to form a fluid seal thereat.

The lower surface 237 has a rectangular slot or opening 238 therein through which projects the tapered stem 232 of the fixed stop member 230. It will be seen that the fixed stop member projects into the axial opening 216 in the housing 212. The seal element 233 engages certain of the edge surfaces defining the opening 238 to form a fluid seal thereat.

The housing member 213 is also provided with a stop member 239 which cooperates with the inner housing member to function as a movable stop member. The movable stop member 239 includes a transverse portion 240 which has a substantially flat lower surface and a convex upper surface. A tapered stem 241 is affixed to the lower surface of the movable stop member and depends therefrom. Seal element 243 extends around the ends and lower edge of the tapered stem 241 and is positioned in a rectangular slot in the transverse portion 240, as seen in FIG. 11. This seal 243 cooperates with the movable stop 239 in the same manner as seal 233 with the fixed stop 230.

The housing member 213 is provided with a rectangular shaped opening 244 therein which is shaped to accommodate the stem 241 of the movable stop member 239 therethrough. The tapered stem of the movable stop member projects into the opening 220 in the housing member 213. The seal element 242 engages certain of the edges defining the opening 244 to form a fluid seal thereat, and engages the other peripheral surfaces defining the opening 244 to form a seal thereat. In the embodiment shown, the transverse portion 240 of the movable stop member will be positioned exteriorly of the housing member 213, but interiorly of the barrel portion 215 of the housing member 212. The movable stop member 239 is movable with the housing member 213 when the latter is rotated to a selected adjusted position. In this regard, the flange 219 of the housing member 213 is provided with radially extending recesses 245 therein to facilitate gripping of the flange with a spanner wrench or other suitable tool to permit rotation of the housing member to the desired setting.

The rotary fluid pressure device 210 is provided with a vane rotor assembly 246 which is comprised of an elongate shaft 247 that projects through the housing 211. One end portion of the shaft 247 is journaled in a bearing 248 which is positioned within a recess 249 in the block portion 214 of the housing member 212. A retainer ring 250 engages in a groove on the end portion of the shaft 247 to prevent axial displacement of the shaft relative to the housing.

The other end portion of the shaft is threaded, as at 251, and projects through a bearing 252 positioned within an annular recess 253 formed in the end of the housing member 213. a spacer 254 is positioned around the end of the shaft 247 and is interposed between the shaft bearing 252 and a lock nut 256. The lock nut 256 threadedly engages the threaded portion 251 of the shaft and locks the shaft 247 against axial displacement.

The shaft 247 has a chamber defining outer collar member 257 affixed thereto, adjacent the threaded end thereof, and another chamber defining outer collar member 258 affixed thereto, adjacent the non-threaded end portion thereof. The outer collar member 257 has an annular groove therein for accommodating an O-ring seal 259 therein. The outer collar member 258 also has an annular groove therein for accommodating an annular O-ring seal 260 therein. It will be noted that the outer collar member 257 has a greater axial dimension than the axial dimension of the outer collar member 258. It will further be noted that the O-ring seal 259 on outer collar member 257 is located adjacent the inner end portion thereof.

An intermediate chamber defining collar member 261 is positioned between and spaced from the outer collar members 257 and 258, respectively. The inner collar member is also provided with annular grooves therein for accommodating O-ring seal elements 262. When the rotary fluid pressure device is assembled, the spacing 263 located between the outer collar member 258 and the intermediate collar member 261 cooperates with the interior of the housing member 212 to define a fluid pressure chamber 264. Similarly, the spacing 265 located between the outer collar member 257 and the intermediate collar member 261 cooperates with the interior of the housing member 213 to define an annular fluid pressure chamber 266.

The outer collar member 258 and the intermediate collar member 261 have slots 267 therein which communicate with a slot in the shaft 247 for receiving peripheral portions of a vane 268. The vane has a seal element 269 positioned in a slot formed in one surface thereof. It will be noted that the outer edge of the vane 268 is coextensive and substantially coplanar with the periphery of the collar members 258 and 261.

The collar member 257 and the collar member 261, as well as the shaft 247, have slots therein that communicate with each other and that receive and accommodate the rectangular vane 271 therein. The vane 271 has seal elements 272 positioned in a slot formed in one surface thereof. When the vane 271 is assembled in pressed relation with the rotor assembly, the lower or outer edge of the vane is coextensive with the collar members 257 and 261. It will also be seen that the vane 268 is disposed in axial alignment with the vane 271. When the fluid pressure device 210 is assembled, the vane 268 will be disposed in the chamber 264 and vane 271 will be disposed in chamber 266.

The intermediate chamber defining collar member 261 has an axial opening therethrough which defines a transfer port 273 located on one side of the vane 268 and the same side of the vane 271. The collar member 261 also has a second opening therethrough which defines a transfer port 274 that intercommunicates the chambers 264 and 266 on the same respective sides of the vanes 268 and 271.

The port block 229 has a primary port 275 therein that extends through the port block and the stem of fixed stop member 230 to intercommunicate the exterior with the chamber 264 on one side of the fixed stop member 230. The port block also has a second primary port 276 which extends through the port block and the stem of the fixed stop member 230 to intercommunicate the exterior with the chamber 264 on the other side of the fixed stop member 230. The ports 275 and 276 are connected to a source of fluid under pressure in the manner of the embodiment of FIGS. 1 to 6.

Thus, a suitable control valve will control the direction of flow of the fluid to and from the ports 275 and 276. With this arrangement, when fluid is introduced into the port 275, the fluid will act against one surface of the vane 268 while simultaneously passing through the transfer port 273 into the chamber 266. The rotor assembly will be rotated in one direction until the vane 271 engages the movable stop 239. Thereafter, the direction of the flow of the fluid will be reversed and fluid will be introduced into the port 276 and through the transfer port 274 while fluid will be evacuated from the port 275. This will cause the rotor assembly to rotate in the opposite direction until the vane 268 engages the fixed stop member 230.

When it is desirable to adjust the position of the movable stop member, a user will loosen the lock nut 256 and will use a spanner wrench to rotate the housing member 213 to a desired setting. Thereafter, the lock nut will be tightened and the stroke of the rotor assembly will be determined by the new setting and position of the movable stop member. With this arrangement, the stroke of the rotor assembly can be variously adjusted over a wide range of adjustment.

Referring now to FIGS. 12, 13 and 14, it will be seen that a further embodiment of the novel rotary fluid pressure device, designated generally by the reference numeral 310, is thereshown. The device 310 includes a housing 311 comprised of a pair of housing members 312 and 313, respectively. The housing member 312 is provided with an elongated axially extending element 314 which projects through an opening 315 in the housing member 313.

In the embodiment shown, the shaft element 314 projects completely through the housing member 313, and a clamping ring 316 is mounted on the shaft element and engages the outer face of the housing member 313. The clamping means 316 is a split ring type and is tightened and loosened by a conventional clamping ring bolt 317. The clamping ring 316 has an axial opening 318 therethrough accommodating a retaining pin 319 that engages in a recess in the housing member 313. It will therefore be seen that the housing member 313 and the clamping ring 316 are revolvable as a unit relative to the housing member 313 when the bolt 317 of the clamping ring is loosened in the manner of the previously described embodiments.

The clamping ring 316 is clamped against axial displacement by means of a retaining ring 320 and engages in an annular groove in the shaft element 314. It will also be noted that a seal ring 321 is positioned in an annular recess in the outer face of the housing member 313 and engages the shaft element 314 and the clamping ring 316 to form a fluid seal thereat.

Referring now to FIG. 14, it will be seen that the clamping ring 316 is provided with an ear **316*a* that projects radially therefrom and which has an outer surface 316*c* that is provided with a pointer 316*b***.

A generally circular dial 322 having a central opening therethrough is positioned on the outer end portion of the shaft element 314 and is secured in mounted relation thereon by a retaining ring 323. It will be noted that the dial 322 has an inturned annular flange **322*a* that extends axially forwardly therefrom, and is positioned in close proximal relation with respect to the outer surface 316*c* of the ear 316*a* on the clamping ring 316. The outer surface of the flange 322*a* is provided with a scale 322*b* which cooperates with the pointer 316*b*** to indicate a reading or setting of the adjustable stop member in a manner to be described hereinbelow.

It will be seen that the clamping ring 316 clamps the housing member 313 on the shaft element 314 and in confronting relation with respect to the housing member 312. The housing member 312 is provided with an annular recess 324 therein, and the housing member 313 is provided with an annular recess 325 therein. It will be seen that these annular recesses are disposed in registering relation with respect to each other. It will also be seen that the housing member 312 has an annular groove therein for accommodating a seal ring 326. The housing member 313 also has an annular groove therein for accommodating a seal ring 327 therein. In the embodiment shown, these seal rings are in confronting relation with respect to each other.

The fluid pressure device 310 also includes a vane rotor assembly 328 which is comprised of a relatively large circular disk 329 having a centrally located opening 330 therethrough, and a circular smaller disk 331 having a centrally located opening 331*a* therethrough. The shaft element 314 projects through the openings in these disks so that the disks are journaled for rotation relative to the shaft element 314. The disks 329 and 331 are secured together in face-to-face relation and each is grooved to accommodate a seal ring 332 therein which also sealingly engages the shaft element 314. A seal ring 333 is interposed in grooves in the confronting faces of the disks 329 and 331 outwardly and concentrically of the seal ring 332. It will be noted that the seal ring 333 is disposed in axial alignment with the seal rings 326 and 327, respectively. It will also be noted that the disks have aligned openings therein for accommodating an alignment lug 334 which facilitates assembly of the vane rotor assembly in the manner of the previously described embodiments.

The large circular disk 329 projects outwardly beyond the housing 311 while the smaller circular disk is contained within the housing. The larger circular disk is provided with an annular lip 335 which projects axially in one direction and an annular lip 336 which projects axially in the opposite direction. In the embodiment shown, the smaller circular disk 331 has its outer circumferential surface positioned concentrically within the annular lip 336. It will also be noted that these annular lips are disposed in axial alignment. The housing 311 is provided with a pair of bearing rings 337, one of which engages one surface of the large disk 329 and the other of which engages the opposite surface thereof. Each bearing ring 337 is provided with an axially extending annular lip 338. It will be seen that the annular lip 338 of one bearing ring engages the lip 335 and underlies a shoulder 339 of the housing member 312. The annular lip on the other bearing ring 337 engages the annular lip 336 of the disk 329 and underlies a shoulder 340 of the housing member 313.

The disks 329 and 331 have registering openings therein for accommodating a generally rectangular shaped vane 341 therethrough. The vane is provided with a seal and is of similar configuration to the vane carried by the disk in the embodiments of FIGS. 1 to 6. The disks 329 and 331 also cooperate with the housing members 312 and 313 to form the interior thereof into a pair of separate chambers. One portion of the vane 341 projects into the chamber defined by the annular recess 324 in the housing member 312, and the other portion of the vane projects into the chamber defined by the annular recess 325 in the housing member 313. When hydraulic fluid is introduced into the chambers, the hydraulic fluid will act against the surfaces of the vane to move the vane in one direction or the other. Thus, the hydraulic fluid will cause the vane and the disks to operate in opposite directions depending on the direction of flow of the hydraulic liquid.

The vane 341 is provided with ears 342, each having an opening therethrough. One of the openings defines a transfer port 343 and the other opening defines a transfer port 344. It will be seen that one of the transfer ports intercommunicates the chambers on one side of the vane and the other transfer port intercommunicates the chambers on the other side of the vane.

The housing member 312 is provided with a positioning recess (not shown) therein which receives a fixed stop member 345 that is positioned in obstructing relation with respect to one of the portions of the vane 341. The housing member 313 is also provided with a positioning recess (not shown) which accommodates a movable stop member 346 therein. The movable stop member is also positioned in obstructing relation with the other portion of the vane 341. It will therefore be seen that the relative positions of the stop members determine the amount of reciprocating revolving movement of the vane rotor assembly 328.

The housing member 312 is provided with a pair of primary ports 347 and 348 which communicate with the chamber defined by the annular recess 324 in the housing member 312. Again it is pointed out that the primary port 347 communicates with the chamber on one side of the fixed stop member 345 and the other primary port 348 communicates with the chamber on the other side of the fixed stop member. The primary port 347 is connected by conduit 349 to a valve 351 and the primary port 348 is connected by a conduit 350 to the valve 351. The valve 351 is connected by a conduit 352 to a reservoir 353. The valve 351 may also be connected by suitable conduits 354 and 355 to another implement such as a hydraulic motor or the like. Although the rotary fluid pressure device illustrated in the embodiments of FIGS. 12, 13 and 14 has broad utility, in the embodiments shown, the device is used as a pump. An actuator member 356 is secured to a marginal portion of the larger disk 329 by bolts 357. With this arrangement, when the actuator member 356 is reciprocated in the direction of the arrows, the direction of flow of the fluid will be controlled by this motion. The fluid will be alternatively directed outwardly through the primary port 347 and the primary port 348.

Referring now to FIGS. 15, 16, 17 and 18, it will be seen that a modified form of the embodiment of FIGS. 12 through 14 is thereshown. The fluid pressure device 410 includes a housing 411 comprised of a housing member 412 and a housing member 413. A shaft 414 projects through an opening 415 in housing member 412 and an opening 416 in housing member 413. The shaft 414 is in the form of a bolt and is provided with a head 417 that is positioned in a recess 412*a* of the housing member 412. A seal ring 412*b* is positioned in an annular recess in the housing member 412 and is sealingly engaged by the lower surface of the head 417 of the shaft 414 to form a fluid seal thereat.

The shaft 414 also has a threaded shank portion 418 adjacent its other end and is provided with splines 419 intermediate the threaded shank 418 and the head 417. A lock nut 420 threadedly engages the threaded shank 418 and is retained against axial displacement by a retaining ring 421.

A keyed bushing 422 having a splined opening 423 therethrough accommodates one end of the shaft 414 so that the splines defining the opening 423 engage the splines on the shaft 414. The bushing 422 also has a recess 424 therein which accommodates the lock nut 420. It will be seen that the housing member 413 also has a recess 425 therein which receives a portion of the bushing 422. A spacer 426 is interposed between the bushing 422 and the face defined by the recess 425 in the housing member 413. The housing member 413 is provided with an annular recess for accommodating a seal ring 427 therein, the seal ring engaging the spacer 426 and engaging the shaft 414 to form a fluid seal thereat.

The bushing 422 is also provided with a radial flange 428 that extends outwardly therefrom. Although not shown in the drawing, the circumferential edge 429 of the flange 428 is provided with a pointer which cooperates with a calibrated scale on the clamping ring 430 to indicate the setting of the movable stop member in the manner of the previously described embodiments. The clamping ring 430 is a split type clamping ring and is positioned on the bushing 422 and is tightened thereon by a conventional clamping ring bolt 431. The clamping ring also has an axial opening 432 therein that is disposed in alignment with an axial opening 433 in the housing member 413 for accommodating a pin 434 that locks the housing member 413 and the clamping ring together. The housing member 413 is provided with radial openings 435 in its circumference to facilitate gripping by a spanner wrench or other tool to thereby permit rotation of the housing member 413 relative to the housing member 412.

The housing member 412 is provided with an annular recess 436 therein and the housing member 413 is provided with an annular recess 437 therein. When the housing members are clamped together on the shaft 414, it will be seen that these annular recesses are disposed in confronting relation and define the hollow interior for the housing 411. The fluid pressure device 410 is also provided with a vane rotor assembly which is journaled on the shaft 414 for rotation relative thereto.

The vane rotor assembly 438 includes a circular disk 439 having a central opening 440 therein in which is positioned a ring element 441. The shaft 414 projects through the ring element 441 to journal the disk 439 thereon. The disk 439 is similar to the large disk of the vane rotor assembly in the embodiment of FIG. 12 and projects outwardly of the housing 411. The circular disk is provided with an annular lip 442 that projects axially from one surface thereof and an annular lip 443 that projects axially from the other surface thereof. It will be noted that the annular lips 442 and 443 are disposed in coaxial relation and are interposed between the central opening 440 from the circumferential edge of the disk 439.

The housing 411 is provided with a pair of bearing rings 444, each having an annular lip 445 projecting therefrom and each bearing ring engaging one surface of the disk 439. It will be seen that the lip on one of the bearing rings 444 underlies a shoulder 446 on the housing member 412, and the annular lip on the other bearing ring underlies a shoulder 447 on the housing member 413. The housing member 412 is provided with an annular groove therein for accommodating a seal ring 448 which sealingly engages the lip 442 on the disk 439. Similarly, the housing member 413 is provided with an annular groove for accommodating a sealing ring 449 that sealingly engages the lip 443 to form a fluid seal thereat.

The circular disk 439 extends completely through the housing 411 and thereby forms the interior thereof into a pair of chambers defined by annular recess 436 in the housing member 412 and the annular recess 437 in the housing member 413. The chamber defined by the annular recess 436 in the housing member 412 is provided with a positioning recess for receiving the fixed stop member 450 therein. Similarly, the annular recess 437 in the housing member 413 is provided with a positioning recess for accommodating the movable stop member 451 therein. It will be appreciated that the position of the movable stop member may be variously adjusted by rotating the housing member 413 relative to the housing member 412.

Referring again to FIGS. 15 and 17, it will be seen that the vane rotor assembly includes a circular vane 453 which is mounted in the circular disk 439. In this regard, it will be noted that the circular disk 439 has a radial slot 454 therein that extends radially from the circular opening 440 in the disk to a point adjacent but spaced from the annular lips 442 and 443. The vane 453 is provided with opposed pairs of guide elements 455 that project from the vane and guide the vane into proper seated relation in the slot 454. When the vane is assembled with the disk 439, the vane will be inserted into the central opening 440 and then dropped into the slot 454. The central ring 441 is then positioned in the opening 440 of the disk and the vane rotor assembly is then mounted on the shaft 414.

It will be noted that the disk 439 has a pair of opposed arcuate recesses therein which face each other and which communicate with the slot 454 therein. These arcuate recesses cooperate with arcuate recesses in the guides 457 to define a transfer port 458 and a transfer port 459 located on opposite sides of the vane 453. These transfer ports intercommunicate the chambers defined by the arcuate recesses 436 and 437 in the housing members.

The housing member 412 has a primary port therein provided with the fitting 460 which communicates with the chamber defined by the arcuate recess 436 on one side of the fixed stop member 450. The housing member 412 also has another primary port therein provided with a fitting 461 which communicates with the chamber 436 on the other side of the fixed stop member. It will therefore be seen that the embodiment of the rotary fluid pressure device disclosed in FIGS. 15 through 18 operates in the same manner as the embodiment of FIGS. 12, 13 and 14.

The fittings 460 and 461 will be connected by suitable conduits to a valve, and, if the device is used as an actuator, rotary motion of the vane rotor assembly will be used to operate another device. Conversely, the rotary motion of the vane rotor assembly may be used to direct the fluid, through the device so that the latter functions as a pump, as illustrated in FIG. 14.

It will be noted that the embodiments of FIGS. 12 through 18 utilize a revolvable disk on a stationary shaft. In the embodiments of FIGS. 1 through 11, the rotary motion is transmitted to a rotary shaft and this motion is used to operate another device.

From the foregoing description, it will be seen that the fluid pressure actuator has wide utility and may be used to function as a pump to control operation of another device operated by the pump, or may be used to operate other devices such as valves, switches, robots and the like. In the embodiments of FIGS. 1 to 11, the rotary motion produced by movement of the vane rotor assembly is transmitted to a shaft that functions as the output means. In the embodiments of FIGS. 12 through 18, the rotary motion imparted to the vane rotor assembly is transmitted directly from the vane rotor assembly. The use of internal stop members which may be relatively adjusted with respect to each other permits the actuator device to have a wide range of adjustment by simple mechanical manipulation. Applicant knows of no similar type arrangement in an actuator of this kind.

Thus it will be seen that I have provided a rotary fluid pressure actuator device which is not only of simple and inexpensive construction, but one which functions in a more efficient manner than any heretofore known comparable device.

While the preferred embodiments of the present invention have been described, it should be understood that various changes, adaptions and modifications may be made therein without departing from the spirit of the invention and the scope of the appended claims.

What is claimed is:

1. A variously adjustable device for producing reciprocating rotary motion, comprising:

a housing including a pair of housing members each having a hollow interior, means interconnecting said housing members together and permitting one of said housing members to be rotated relative to said other housing member;

means defining a shaft extending through said housing;

chamber defining means in said housing to form the interior thereof into a pair of axially separated chambers, said chamber defining means being revolvable relative to said housing;

vane means connected with said chamber defining means and projecting into said chambers;

a fixed stop member mounted in one of said chambers in obstructing relation with said vane means, said fixed stop member having opposite sides;

a pair of primary ports in said housing connected in communicating relation with a source of fluid under pressure and communicating with one of said chambers, one of said ports being located on one side of said fixed stop member and the other port being located on the other side of said fixed stop member;

a pair of transfer ports in said chamber defining means interconnecting said chambers in communicating relation, one of said transfer ports interconnecting said chambers on one side of said vane means and the other transfer port interconnecting the chambers on the other side of said vane means, whereby when fluid under pressure is introduced through one of said primary ports into said one chamber, said vane means and chamber defining means will be rotated in one direction, and when fluid under pressure is introduced into said one chamber through the other primary port, the vane means and chamber defining means will be revolved in the opposite direction; and a movable stop member mounted in the other of said chambers of said housing in obstructing relation with said vane means and being movable with said one housing relative to said other housing for variously adjusting the position of said stop member relative to said fixed stop member whereby the amount of reciprocating movement of the vane means and chamber defining means may be variously adjusted.

2. The device as defined in claim 1 wherein said chamber defining means comprises a member secured to said shaft and extending radially outwardly therefrom.

3. The device as defined in claim 1 wherein said chamber defining means comprises a disk secured to said shaft and extending radially outwardly therefrom, said vane means being mounted on said disk and extending axially from opposite surfaces thereof.

4. The device as defined in claim 3 wherein said vane means comprises a single substantially flat vane element mounted on said disk and projecting axially therefrom into said chambers.

5. The device as defined in claim 4 wherein said disk is revolvable relative to said shaft.

6. The device as defined in claim 4 wherein said shaft is journaled in said housing for rotation relative thereto, said disk being keyed to said shaft and being revolvable therewith.

7. The device as defined in claim 5 wherein said disk projects axially outwardly of said housing.

8. The device as defined in claim 1 wherein said shaft is revolvable relative to said housing, said chamber defining means comprising a plurality of axially spaced apart collars on said shaft for rotation therewith, each adjacent pair of collars cooperating with the hollow interior of the housing to form the interior into said pair of chambers, said vane means including a pair of axially spaced apart vanes each extending between and engaging a pair of said collars, 9. The device as defined in claim 5 wherein said housing comprises a pair of housing members, means connecting said housing members to permit relative rotation therebetween, the interior of one of said housing members cooperating with said disk to define one of said chambers, the interior of the other housing member defining said other chamber.

10. The device as defined in claim 9 wherein relative rotation between said housing members repositions said movable stop member relative to said fixed stop member.

* * * * *